US011054106B1

(12) United States Patent
Huang

(10) Patent No.: US 11,054,106 B1
(45) Date of Patent: Jul. 6, 2021

(54) LED VEHICLE LIGHT WITH DUAL COLOR LENS INCLUDING THE ILLUMINATED WORD "STOP"

(71) Applicant: Nan Huang Huang, Rancho Dominguez, CA (US)

(72) Inventor: Nan Huang Huang, Rancho Dominguez, CA (US)

(73) Assignee: Grand General Accessories LLC, Rancho Dominguez, CA (US)

( * ) Notice: Subject to any disclaimer, the term of this patent is extended or adjusted under 35 U.S.C. 154(b) by 0 days.

(21) Appl. No.: 16/923,844

(22) Filed: Jul. 8, 2020

Related U.S. Application Data

(60) Provisional application No. 62/873,777, filed on Jul. 12, 2019.

(51) Int. Cl.

| | |
|---|---|
| ***F21S 43/20*** | (2018.01) |
| ***F21V 3/00*** | (2015.01) |
| ***F21S 43/19*** | (2018.01) |
| ***F21S 43/14*** | (2018.01) |
| ***F21V 23/00*** | (2015.01) |
| ***F21W 103/20*** | (2018.01) |
| ***F21Y 115/10*** | (2016.01) |
| ***F21S 45/50*** | (2018.01) |
| ***F21W 103/35*** | (2018.01) |

(52) U.S. Cl.
CPC ..... *F21S 43/26* (2018.01); *F21S 43/14* (2018.01); *F21S 43/195* (2018.01); *F21V 3/00* (2013.01); *F21V 23/002* (2013.01); *F21S 45/50* (2018.01); *F21W 2103/20* (2018.01); *F21W 2103/35* (2018.01); *F21Y 2115/10* (2016.08)

(58) Field of Classification Search
CPC ..... F21S 43/26; F21S 43/14; F21S 43/195; F21V 3/00; F21V 23/002
USPC ..... 362/509
See application file for complete search history.

(56) References Cited

U.S. PATENT DOCUMENTS

| | | | | |
|---|---|---|---|---|
| 2,011,850 | A * | 8/1935 | Clarke | B62J 6/20 40/615 |
| 2,380,691 | A * | 7/1945 | Gross | F21V 11/00 362/510 |
| 4,214,168 | A * | 7/1980 | Kulka | B60Q 1/30 362/540 |
| 4,835,666 | A * | 5/1989 | Feger | F21S 43/255 362/544 |
| 5,931,566 | A * | 8/1999 | Fraizer | F21S 43/26 362/293 |
| 8,154,423 | B2 * | 4/2012 | Wiseman | G08G 1/095 340/907 |
| 2006/0225328 | A1 * | 10/2006 | Hasan | G09F 13/18 40/570 |
| 2008/0013335 | A1 * | 1/2008 | Tsutsumi | B60Q 1/2607 362/545 |

(Continued)

*Primary Examiner* — Bryon T Gyllstrom
(74) *Attorney, Agent, or Firm* — Jen-Feng Lee, Esq.

(57) ABSTRACT

A vehicle light lens including a plastic lens body having an outer surface and an inner surface with an upper section of the inner surface including the word "STOP| etched in amber colored script letters, the plastic lens body including a lower section including a multiplicity of proprietary lights adjacent the lower interior surface. A frosted plastic lens adjacent the etched word "STOP" within the upper section of the plastic lens body. A "STOP" script light tunnel adjacent the frosted plastic lens within the upper section of the plastic lens body.

10 Claims, 5 Drawing Sheets

(56) References Cited

U.S. PATENT DOCUMENTS

| | | | | |
|---|---|---|---|---|
| 2008/0080199 | A1* | 4/2008 | Sassoon | B60Q 1/2607<br>362/487 |
| 2010/0225459 | A1* | 9/2010 | Lee | G09F 13/12<br>340/432 |
| 2014/0268858 | A1* | 9/2014 | Norris | B60Q 1/44<br>362/545 |
| 2017/0241596 | A1* | 8/2017 | Chien | F21S 10/02 |
| 2018/0037156 | A1* | 2/2018 | Stevens | F21S 43/26 |

* cited by examiner

LED VEHICLE LIGHT WITH DUAL COLOR LENS INCLUDING THE ILLUMINATED WORD "STOP"

CROSS-REFERENCE TO RELATED APPLICATION

This patent application claims priority to Provisional Application Ser. No. 62/873,777 filed on Jul. 12, 2019.

BACKGROUND OF THE INVENTION

1. Field of the Invention

The present invention relates to the field alight assemblies used in vehicles. By way of example, the present invention is primarily used for tail lights, rear lights and side lights for classic cars and motorcycles.

2. Description of the Prior Art

The present inventor is not aware of any prior art patents or published patent applications which identically disclose the present invention or would make the present invention obvious.

SUMMARY OF THE INVENTION

The present invention is an all new teacup style vehicle light utilizing vivid LED lights. The word "STOP" is etched into a lens and further highlighted with accessories within the body of the lens. The product includes an innovative dual color lens. The LED vehicle light with the word "STOP" in script letters gives an iconic vehicle light a new life. It presents a modern look while at the same time maintaining a nostalgic and classic original appearance that is very appealing.

When the vehicle brakes are applied, the script letter word "STOP" lights up in a brilliant amber color while the remaining portion stays lit and serves as a stop, turn and running indicator vehicle light.

The complete assembly can have an all-black or polished stainless steel housing. The driver's side light contains a license plate light wherein the lenses are waterproof sealed. The complete assembly and will easily plug into an existing 1156 style socket. The present invention also utilizes existing 1157 wire plug adapters.

An additional model of the present invention is an all red version that has a textured design that looks like glass.

It is therefore an object of the present invention to provide an innovative dual color lens LED vehicle light with the word "STOP" in amber script letters provides gives an iconic vehicle light a new life. It successfully presents a modern look while maintaining a nostalgic and classic original appearance.

It is an additional object of the present invention to enhance the visual notice of a stop symbol so that when the vehicle brakes are applied, the word "STOP" lights up in a brilliant amber while the red portion stays lit and serves as a stop, turn, and running vehicle light.

The present invention includes a multiplicity of lights. As a specific embodiment, a certain "spyder" light, disclosed in U.S. Design Pat. No. D579,591 and issued to the same inventor, can be used in the present invention. Certainly, other suitable lights can be used herein consistent with the teachings of the present application as long as they are within the scope and spirit of the disclosure.

Defined in detail, the present invention is a vehicle light lens comprising:

(a) a plastic body having an outer surface and an inner surface with an upper section of the inner surface including an etched amber colored script word "STOP", the plastic body including a lower section including a multiplicity of spyder lights adjacent the lower interior surface;

(b) a frosted plastic lens adjacent the etched word "STOP" within the upper section of the plastic body;

(c) a "STOP" script light tunnel adjacent the frosted plastic lens within the upper section of the plastic body; and (d) a first upper diode board electronically connected to the "STOP" script light tunnel and a lower second diode board electronically connected to the multiplicity of spyder lights, a first 1157 wire plug adapter electronically connected to the first diode board, the first 1157 wire plug adapter including wires connected to a connector which is electronically connected to a vehicle brake light, a second 1157 wire plug adapter electronically connected to the second diode hoard, the second 1157 wire plug adapter including wires connected to a connector which is connected to a turn signal and stop lights and further including a second wire connected to a plug connected to a license plate light.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
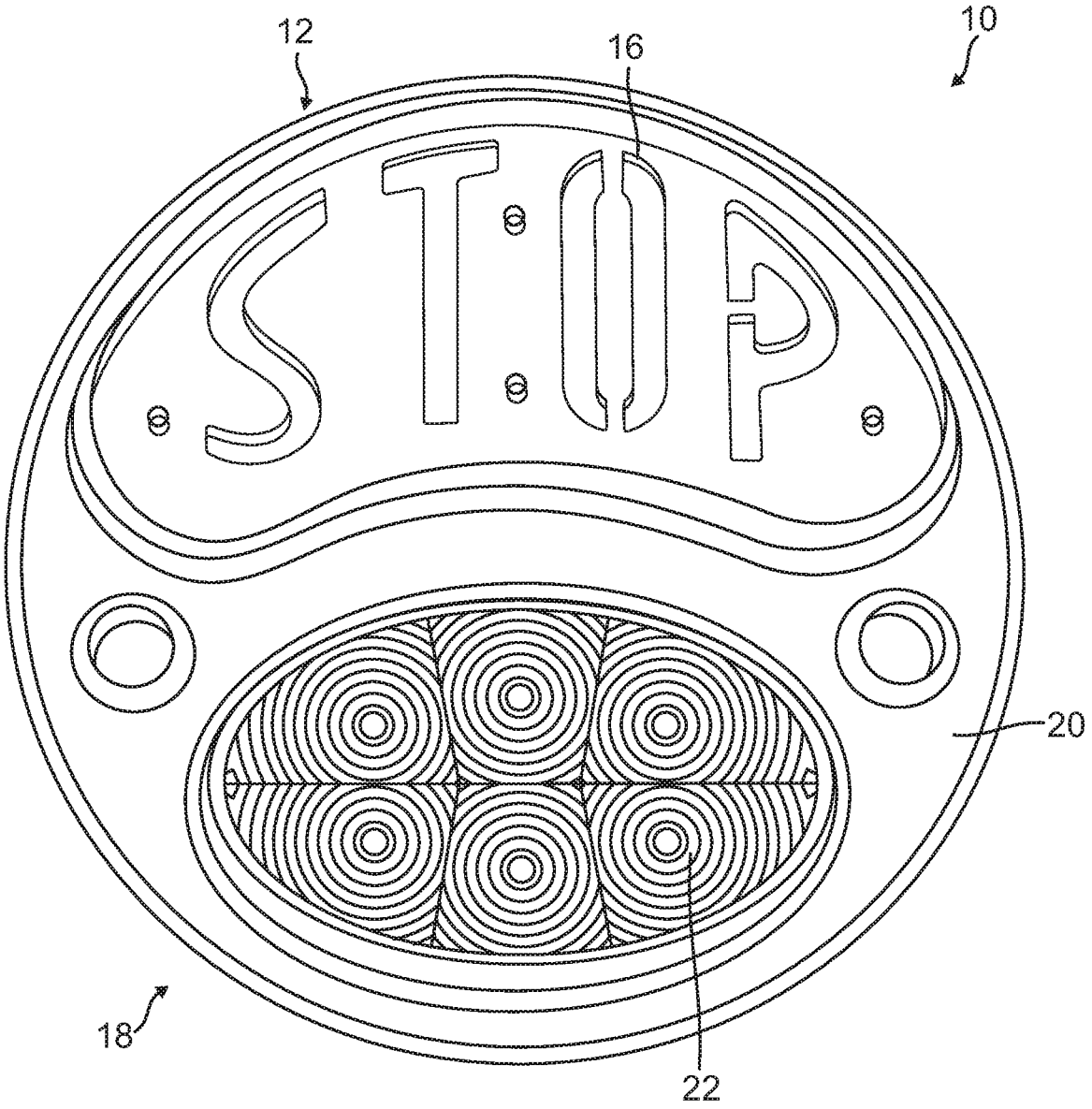
FIG. 1 is a front perspective view of the plastic vehicle light lens with the amber "STOP" letters etched into a rear surface of a plastic vehicle light lens and illustrating the spyder lights below the amber "STOP" letters.
Figure 2:
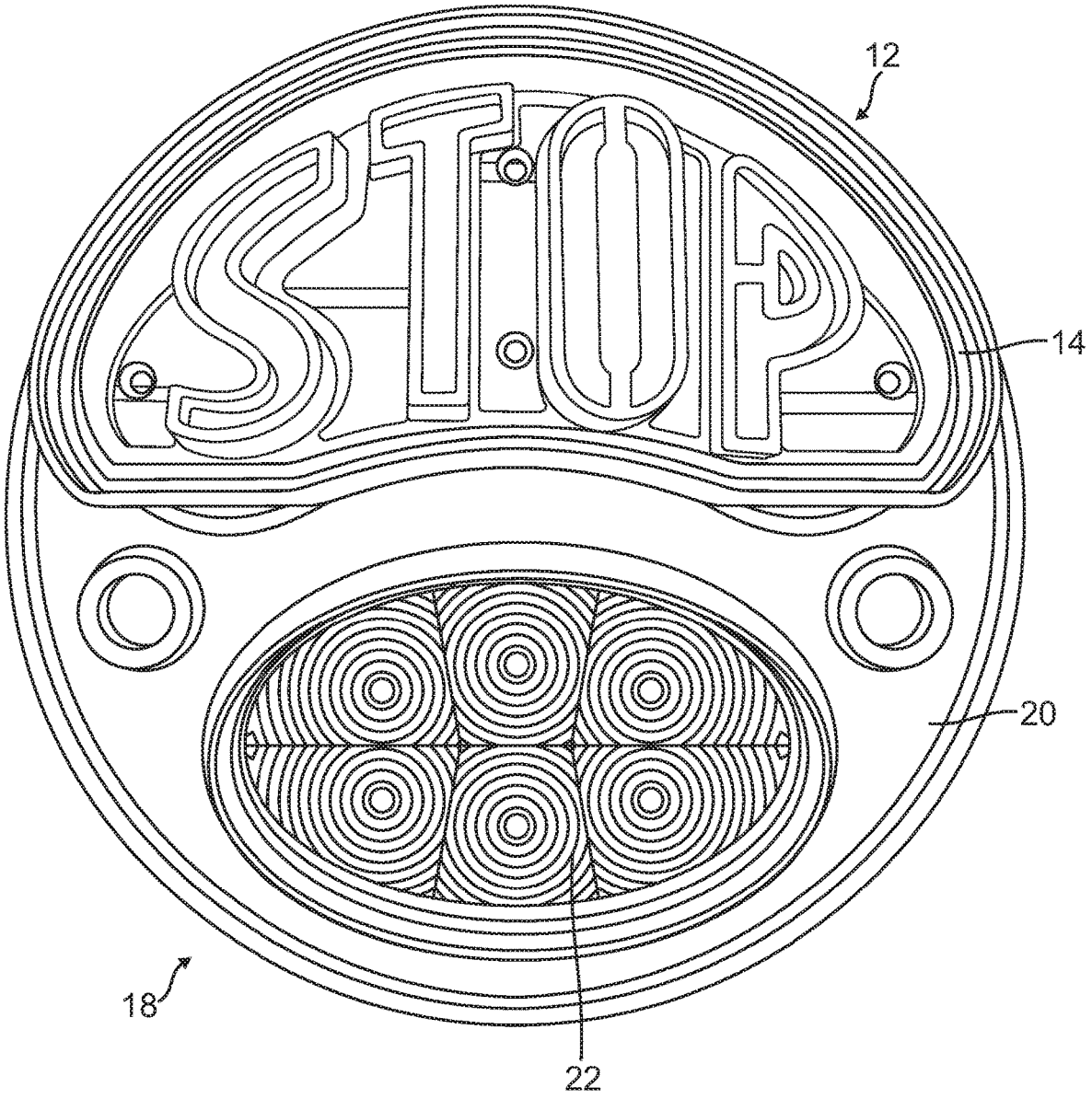
FIG. 2 is a rear perspective view of the plastic vehicle light lens with the amber "STOP" letters etched into a rear surface of a plastic vehicle light lens and a rear view of the spyder lights.

Referring to FIG. 1, there is illustrated a front perspective view of the plastic vehicle light lens with the amber "STOP" letters etched into a rear surface of a plastic vehicle light lens and illustrating the spyder lights below the amber "STOP" letters. Referring to FIG. 2, there is illustrated a perspective view of the plastic red vehicle light lens with the amber "STOP" letters etched into a rear surface of a plastic vehicle light lens and a rear view of the spyder lights.

Referring to FIG. 1 and FIG. 2, there is illustrated a front perspective view of the plastic vehicle light lens 10 with the word "STOP" in script letters 16 thereon. The vehicle light lens includes an upper section 12 with the word "STOP" in script letters 16 etched into the upper interior surface 14 of the red vehicle light lens 10, The red vehicle light lens 10 includes a bottom section 18 with a multiplicity of "spyder" lights 22 adjacent the lower interior surface 20 of the vehicle light lens 10. When used in the application the term "vehicle" includes classic cars and motorcycles and further includes tail lights, rear lights and side lights.

Figure 3:
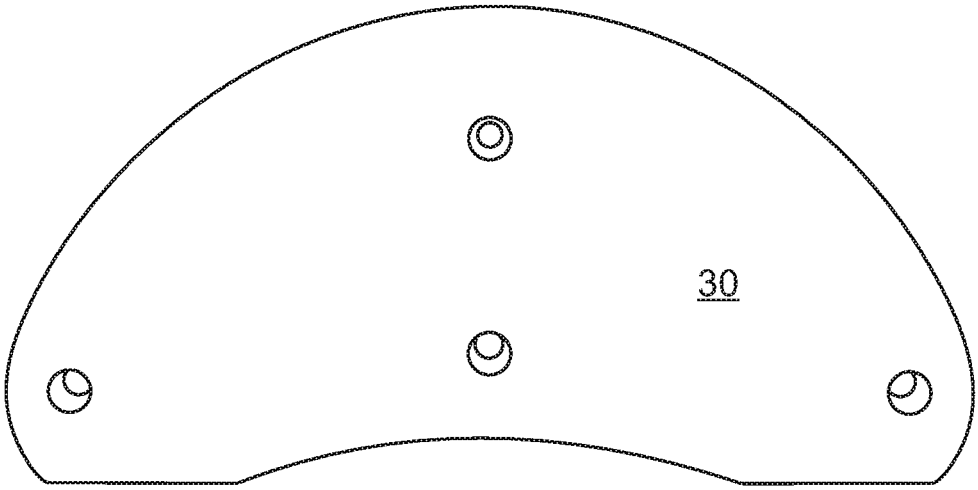
FIG. 3 is a front perspective view of a frosted plastic lens which is placed within the plastic vehicle light lens to enhance the glow effect of the word "STOP"

Referring to FIG. 3, there is illustrated of a perspective view of frosted plastic lens 30 which is placed within the upper section 12 of the plastic red vehicle light lens 10 to enhance the glow effect of the word. "STOP" in script letters 16.

Figure 4:
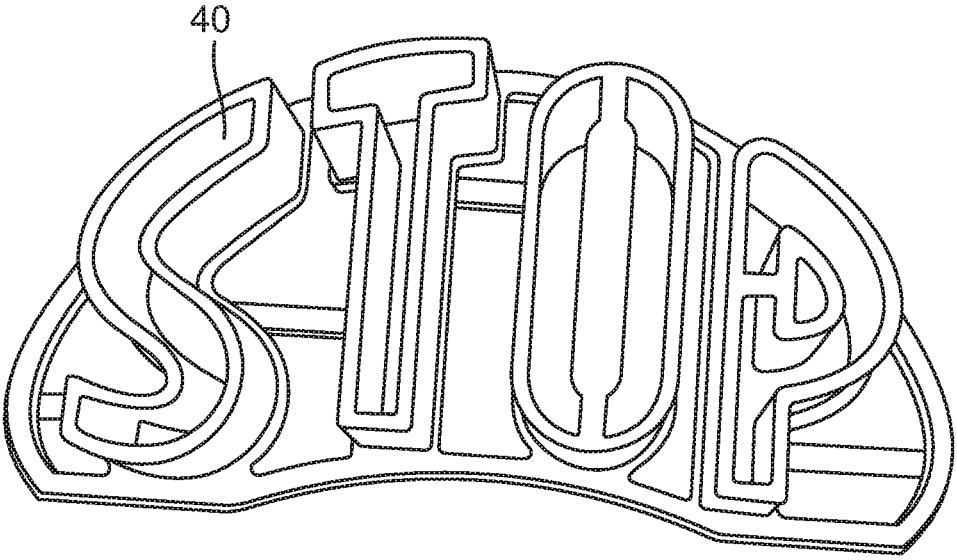
FIG. 4 is a perspective view of a "STOP" script light tunnel to give the word "STOP" a clear amber letter outline. This is placed inside the lens assembly after the frosted plastic lens has been inserted with the plastic vehicle light lens.

Referring to FIG. 4, there is illustrated a perspective view of the "STOP" script light tunnel 40 which gives the "STOP" script letters 16 a clearer amber letter outline. The script light tunnel 40 is placed inside the lens assembly after the frosted plastic lens 30 has been inserted within the plastic vehicle light lens 10.

Figure 5:
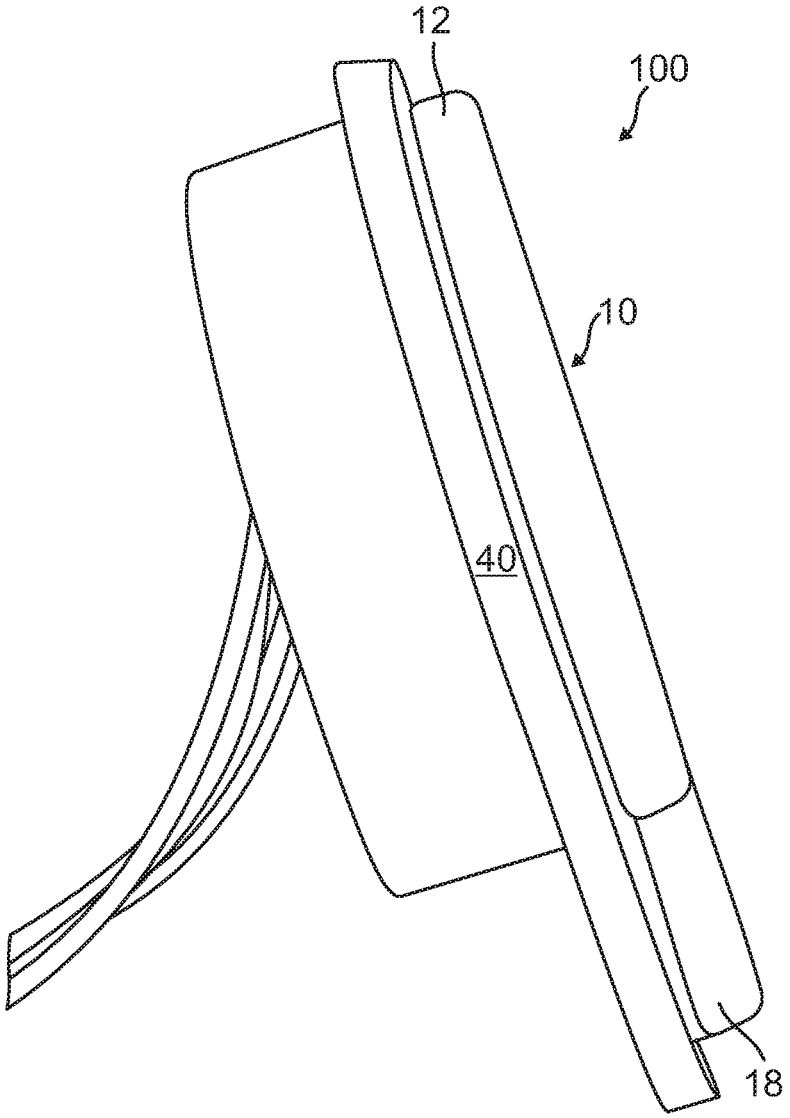
FIG. 5 is a side perspective view of the combined fixture illustrated in FIG. 1, FIG. 2 and FIG. 3.

Referring to FIG. 5, there is illustrated a side perspective view of the upper front portion of the lens assembly 100 including the front plastic lens 10 with the word "STOP" in script letters etched into it, the frosted plastic lens 30 which is placed within the upper section 12 of the plastic vehicle light lens 10 to enhance the glow effect of the word "STOP" in script letters, and the "STOP" script light tunnel 40 to help give the "STOP" script letters 16 a clearer amber letter outline. The "STOP" script light tunnel 40 is placed inside the lens assembly after the frosted plastic lens 30 has been inserted within the plastic vehicle light lens 10.

Figure 6:
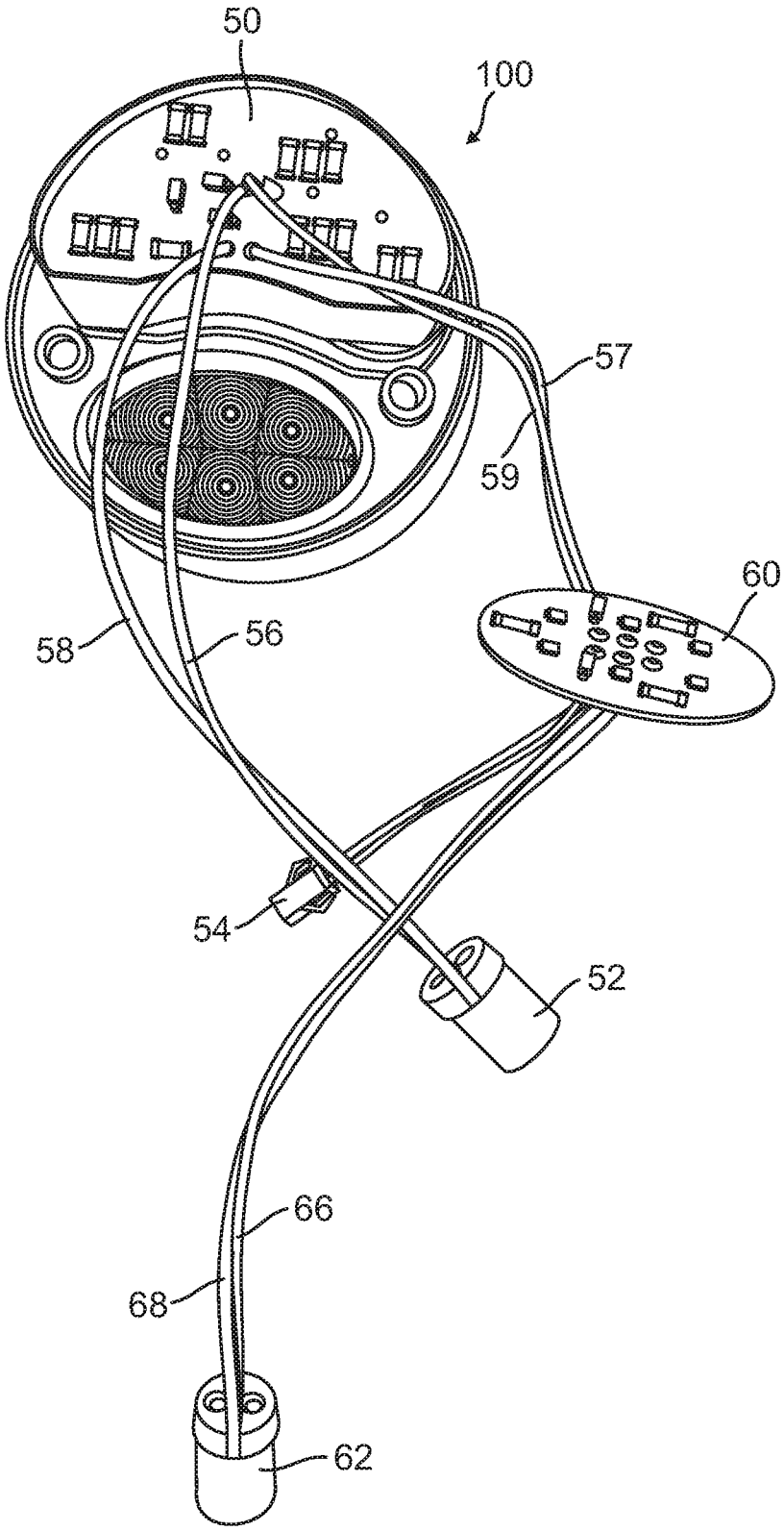
FIG. 6 is a rear plan and perspective view of the rear lens assembly with the upper diode board in place with an existing 1156 socket and an existing 1157 wire adapter with wires connecting the socket and wires to an upper circuit board, the bottom diode board is removed to illustrate the proprietary lights on the bottom half of the lens assembly, with a second existing 1156 socket and a second existing 1157 wire adapter with wires connecting the socket and wires to a lower circuit board.

Referring to FIG. 6, there is illustrated a rear plan and perspective view of the rear lens assembly 100 with the upper diode board 50 in place with an existing type 1156 socket 52 with wires 56 and 58 affixed to the upper circuit board 50. There is also illustrated an existing type 1157 socket 54 with wires 57 and 59 affixed to the upper circuit board 50. The bottom diode board 60 is removed to illustrate the proprietary spyder lights 22 on the bottom half 20 of the lens assembly 10 with a second existing type socket 62 with wires 66 and 68 connecting the socket 62 to a lower circuit board 60.

The first diode board 50 is electrically connected to the "STOP" script light tunnel 40 and the second diode board 60 is electrically connected to the proprietary "spyder" lights 22.

The first diode board 50 has wire 56 and wire 58 connected to the vehicle brake light. The second diode hoard 60 has wire 66 and wire 68 electrically connected to turn signals and stop lights.

Of course the present invention is not intended to be restricted to any particular form or arrangement, or any specific embodiment, or any specific use disclosed herein, since the same may be modified in various particulars or relations without departing from the spirit or scope of the claimed invention herein above shown and described of which the apparatus or method shown is intended only for illustration and the disclosure of an operative embodiment and not to shown all of the various forms or modifications in which this invention might be embodied or operated.

What is claimed is:

1. A vehicle light lens comprising:

(a) a plastic body having an outer surface and an inner surface with an upper section of the inner surface including an etched amber colored script word "STOP", the plastic body including a lower section including a multiplicity of lights adjacent a lower interior surface;

(b) a frosted plastic lens adjacent the etched word "STOP" within the upper section of the plastic body;

(c) a "STOP" script light tunnel adjacent the frosted plastic lens within the upper section of the plastic body; and (d) a first upper diode board electronically connected to the "STOP" script light tunnel and a lower second diode board electronically connected to the multiplicity of lights.

2. The vehicle light lens in accordance with claim 1, further comprising:

(a) a rear lens assembly with an upper diode board in place with a first existing type 1156 socket and a first existing type 1157 wire adapter with wires connecting the first existing type 1156 socket and wires to the upper circuit board; and (b) a bottom diode board behind said lights, with the second existing type 1156 socket and second existing type 1157 wire adapter with wires connecting the second existing type 1156 socket and wires to the lower circuit board.

3. The vehicle light lens in accordance with claim 2, further comprising:

(a) said wires connected to a connector which is electronically connected to a vehicle brake light; and (b) said wires connected to a connector which is connected to a turn signal and to a license plate light.

4. The vehicle light lens in accordance with claim 1, further comprising; the vehicle light is a stop and turn signal light.

5. The vehicle light lens in accordance with claim 1, further comprising:

(a) a rear lens assembly with an upper diode board in place with a first existing type 1156 socket and first existing type 1157 wire adapter with a first pair of wires connecting the first existing type 1156 socket and a pair of wires to the upper circuit board; and (b) a bottom diode board behind said lights, with the second existing type 1156 socket and a second existing type 1157 wire adapter connecting the second existing type 1156 socket and second pair of wires the lower circuit board.

6. A vehicle light lens comprising:

(a) a body having an outer surface and an inner surface with an upper section of the inner surface including an etched amber colored script word "STOP", the body including a lower section including a multiplicity of lights adjacent a lower interior surface;

(b) a frosted lens adjacent the etched word "STOP" within the upper section of the body;

(c) a "STOP" script light tunnel adjacent the frosted lens within the upper section of the body; and (d) a first upper diode board electronically connected to the "STOP" script light tunnel and a lower second diode board electronically connected to the multiplicity of lights, a second diode board electronically connected to a connector which is connected to a turn signal and stop lights and further connected to a license plate light.

7. The vehicle light lens in accordance with claim 6, further comprising:

(a) said first upper diode board electronically connected to the "STOP" script light by a first existing type 1157 wire plug adapter; and (b) said second diode board electronically connected by a second existing type 1157 wire plug adapter to a turn signal and further connected to a license plate light.

8. The vehicle light lens in accordance with claim 6, further comprising:

(a) said first existing type 1157 wire plug adapter including wires connected to a connector which is electronically connected to a vehicle brake light; and (b) said second existing type 1157 wire plug adapter including wires connected to a connector which is connected to a turn signal including a second wire connected to a plug connected to the license plate light.

9. The vehicle light lens in accordance with claim 6, further comprising;

(a) said body is plastic; and (b) said frosted lens is plastic.

10. The vehicle light in accordance with claim 6, further comprising: said vehicle light is a stop and turn signal light.

* * * * *